United States Patent [19]

Englund et al.

[11] 4,019,617

[45] Apr. 26, 1977

[54] PRINTING DEVICE

[75] Inventors: Gösta R. Englund, Stockholm; Ernst C-G Lindelöw, Taby, both of Sweden

[73] Assignee: Svenska Dataregister AB, Solna, Sweden

[22] Filed: Oct. 16, 1975

[21] Appl. No.: 622,937

Related U.S. Application Data

[63] Continuation of Ser. No. 439,957, Feb. 5, 1974, abandoned.

[30] Foreign Application Priority Data

Feb. 9, 1973 Sweden ..... 7301788

[52] U.S. Cl. ..... 197/133 R; 101/91; 101/66

[51] Int. Cl.[2] ..... B41L 47/46

[58] Field of Search ..... 101/66, 18, 90, 67, 101/91, 92, 228, 219, 245, 337; 197/178, 18, 53–55, 133 R

[56] References Cited

UNITED STATES PATENTS

| | | | |
|---|---|---|---|
| 2,235,130 | 3/1941 | Webb | 101/66 |
| 2,310,262 | 2/1943 | Shields | 101/247 X |
| 2,993,435 | 7/1961 | Marshall et al. | 101/66 |
| 3,037,447 | 6/1962 | Gonzalez et al. | 101/91 |
| 3,217,639 | 11/1965 | Kelly | 101/91 X |
| 3,220,342 | 11/1965 | Ritzerfeld | 101/91 |
| 3,242,854 | 3/1966 | Ritzerfeld et al. | 101/91 |
| 3,323,449 | 6/1967 | Ritzerfeld | 101/91 |
| 3,356,202 | 12/1967 | Goff | 197/175 |
| 3,450,041 | 6/1969 | Gentry et al. | 101/90 |
| 3,589,281 | 6/1971 | Woodhead | 101/91 |
| 3,734,011 | 5/1973 | Williams | 101/91 |

*Primary Examiner*—Edward M. Coven
*Attorney, Agent, or Firm*—Robert F. Rotella; Norman Friedman

[57] ABSTRACT

A printing device including a printing station for printing on labels which may be in visually and machine readable formats, comprises rotatable typewheels and pressure rollers which can be brought into engagement for printing on the label while advancing it through the printing station. Drive means coupled to the typewheels and pressure rollers continually rotate the wheels and rollers at the same peripheral speed during and after engagement.

7 Claims, 7 Drawing Figures

II
III
117
114
162
164
12
172
160
116
166
176a
178a
4
174
W
104
176f
178f
68
24
16
18
20
170
26
22
168
14
18a
R
W
52
62
106
50
64
108
44
32
54
38
40
102
58
48
66
65
56
60
28
90
94
92
96
100
40a
38a
98
40b
70c
72a
40c
30
70a
72c
70
74
72
72b
36
78
2
8

PRINTING DEVICE

This is a continuation of application Ser. No. 439,957 filed Feb. 5, 1974 now abandoned.

The present invention relates to a printing device for printing labels with visually readable and/or electro-optically readable text.

Labels printed with a visually readable text denoting the price and type of goods etc. and affixed to the goods by means of an adhesive have long been used within the retail trade. In recent years, the trade has begun to use labels capable of being read by optical and magnetic reading devices. In addition to a visually readable text, normally disclosing the price of the goods the labels have also been provided with a code corresponding totally or partially to the visually readable text. This code, for example, may comprise magnetically or optically detectable dash-lines or circles recorded on the label in spaced apart relationship. When magnetically readable labels are used, a printing device must be employed in addition to a magnetic recording device, the printing device printing the labels with visually readable text denoting the price of the goods. When using optically readable labels, the same printing device can be used for recording both the visually readable text and the optical code.

The present invention relates to a printing device of the last mentioned type, i.e. a printing device which provides the label with a visually readable text and an optically readable code simultaneously.

To this end, the printing device of the present invention comprises a constantly rotating typewheel shaft on which two typewheels provided with visually readable text and optically readable character codes respectively are fixedly arranged. An electro-magnet is provided for each type wheel and is energized electronically at a point of time when the character or code to be printed is located opposite a label present on a strip of labels; whereat a pressure roller arranged to be activated by the electromagnet and to rotate at substantially the same peripheral speed as the typewheel is brought into abutment with the label so as to urge the same against the typewheel until the character or code has been printed onto the label, whereafter the pressure roller returns to its inactive position. Arranged between the label strip and the typewheels is a single ink ribbon which is used a first time for printing the code and a second time for printing the visually readable characters. The label strip and the ink ribbon are fed between the different printing positions automatically by means of positive rolling co-action between the type wheels and the pressure rollers, and successive labels are fed to printing positions by means of special projections or feed dogs arranged on one type wheel, said projections being located in the path of movement of the label strip but outside the path of movement of the ink ribbon, and which projections are arranged to operate in driving conjunction with associated pressure roller in the same manner as the type on the typewheel co-act with said roller.

The characterizing features of the invention are disclosed in the accompanying claims. Further characterizing features of the invention and advantages afforded thereby will be evident from the following description, which is made with reference to an embodiment of the invention disclosed in the accompanying drawings. In the drawins:

FIG. 2 also shows an ink ribbon cassette incorporated in the printing device;

Figure 1:
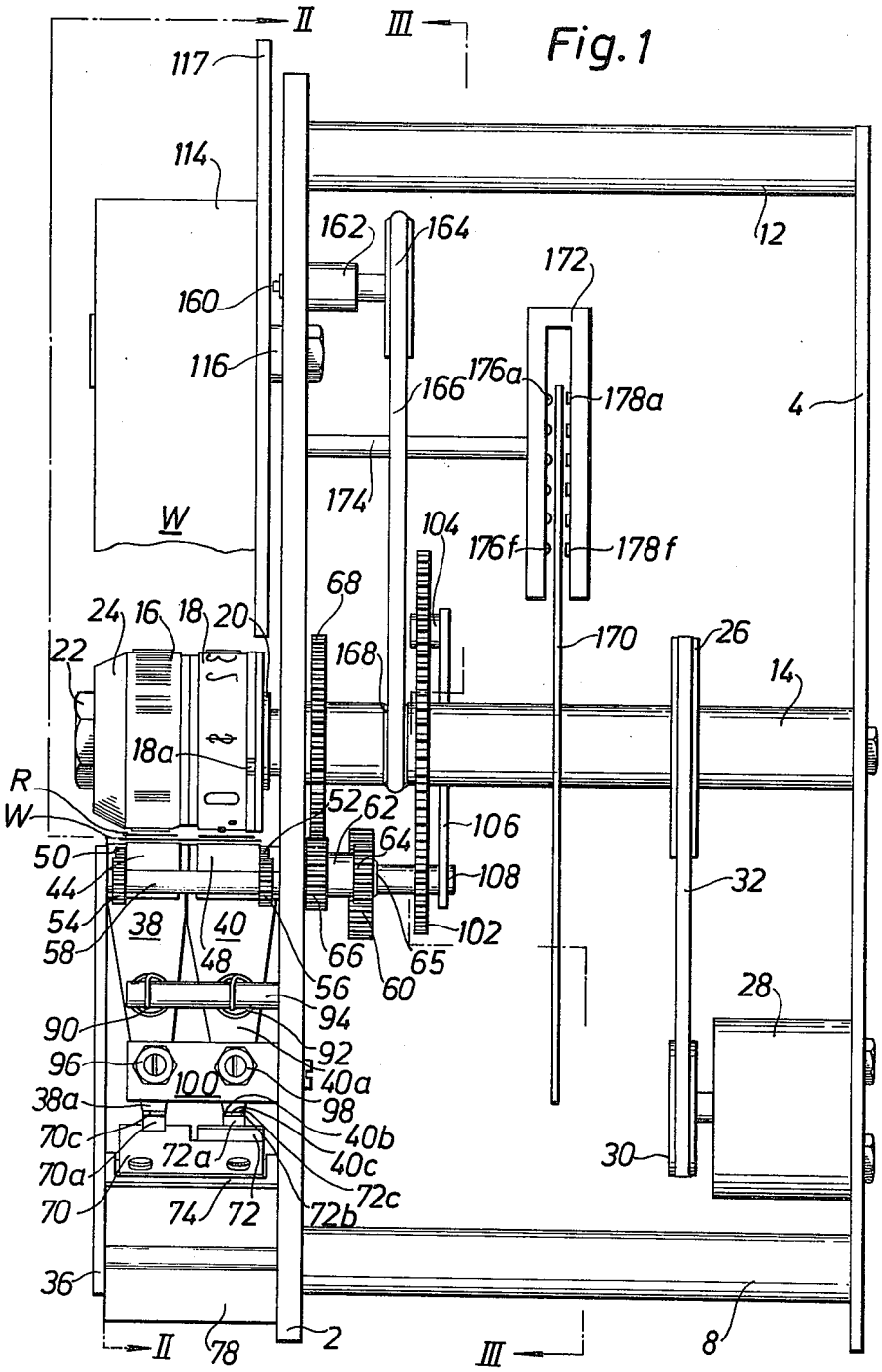
FIG. 1 is a side view of a printing device according to the invention.

The components forming part of the printing device are carried by two ridgid frame plates 2 and 4 connected together by means of four spacer shafts 6, 8, 10 and 12. A type wheel shaft 14 is mounted for rotation in plates 2 and 4 (see FIG. 1) and has arranged thereon two typewheels 16 and 18. The typewheels 16 and 18 which abut each other and cannot be rotated on the shaft 14, are pressed against an anvil 20 arranged on said shaft by means of a nut 22 screwed onto the shaft 14. A washer 24 is located between these nuts 22 and the typewheel 16.

Arranged in uniform spaced relationship around the periphery of the typewheel 18 are eighteen projections, the majority of which comprise characters in the form of digits. With the present embodiment, the projections comprise when seen in sequence $T_1$$, (B), 0,1, 2, 3, 4, ., $T_2$, -, 6, 7, 8, 9, 5, 0 and (E), where $T_1$ and $T_2$ are not print characters but comprise two rectangular projections 18*a* and 18*b* on the portion of the typewheel 18 located furthest to the right in FIG. 1, said projections being used for advancement of a label strip which is to be printed, where $ is a dollar character, where . is a full stop, where - is a hyphen and where the remaining characters represent the digits 0–9. As will be evident from the aforegoing, the digit 0 appears twice. This is due to the fact that the digit 0 is printed much more frequently than the remaining characters arranged on the typewheel 18. The particular sequence of the characters and projections 18*a* and 18*b* on the type wheel 18 has been chosen so that the least possible number of revolutions of the wheel are required to print a number of characters in sequence and to feed the label strip W the requisite number of steps between printing operations. Located between the character $ and the character 0 furthest to the left in the aforementioned sequence of characters is the letter B, while after the second character 0 furthest to the right in said character sequence is the letter E. The letters B and E, however, are not found in these positions, and said positions are completely without the aforementioned projections. The functions of these letters will be described hereinafter.

The typewheel 16 has the same diameter as the typewheel 18 and is provided around its periphery with 13 groups of dash-like projections, each group comprisng at least four dashes of equal length arranged in spaced relationship with respect to each other. One such group of dashes forms a code corresponding to the character arranged on typewheel 18 adjacent said group, i.e. each character with the exception of $T_1$, $, ., - and $T_2$ has a corresponding code shown to the left of said characters in FIG. 1. Thus, no code-forming projections are to be found adjacent the last mentioned characters on the typewheel 16, although such projections are found on the typewheel 16 adjacent the letters B and E on the typewheel 18, which comprise codes, of which one (the start code) shall always be printed before the first code group in a word, and the second (the stop code) shall always be printed after the last code group in the word. Since the typewheels 16 and 18 cannot be rotated relative to each other, the visually readable text on the labels cannot be displaced relative to the optically readable text thereon, as will be understood from the aforegoing.

Securely mounted to the typewheel shaft 14 is a pulley 26, which is driven by the motor 28 attached to the frame plate 4 via a pulley 30 secured to the motor shaft and a belt 32 driven by said pulley 30.

With the embodiment of FIG. 1 a four arm holder 38 is mounted for rotation beneath each typewheel 16 and 18 on a shaft 34 secured in the frame plate 2 and to a further frame plate 36 to the left of said frame plate 2. Mounted between two arms of the holder 38 is a shaft 42 (see FIG. 2) on which a steel roller 44 is mounted for rotation. A steel roller 48 is mounted for rotation on a shaft (not shown) arranged between two arms of the holder 40 in the same way as shaft 42.

A gear wheel 50 is affixed at roller 44, while a gear wheel 52 is attached at roller 48. The gear wheels 50 and 52 mesh with gear wheels 54 and 56 securely arranged on a shaft 58, which is mounted for rotation in frame plates 2 and 36 and which extends on the other side of frame plate 2 where said shaft carries a gear wheel 60 which meshes with one gear path of an intermediate gear wheel 62. The gear wheel 62 is mounted for rotation on a shaft 35 and the other gear path 66 of said gear wheel 62 meshes with a gear wheel 68 mounted on the typewheel shaft 14.

When the typewheel shaft 14 rotates, the gear wheel 68 will rotate the gear wheels 50 and 52, via the intermediate wheel 62, the gear wheel 60 and the gear wheels 54 and 56, at the same speed, the magnitude of which is determined by the rotary speed of the typewheel shaft 14 and the transmission ratio between the gear wheels 68, 62, 60, 54, 56, 50 and 52. In the illustrated embodiment, the transmission ratio is selected so that not only do the rollers 44 and 58, which are connected with gear wheels 50 and 52, rotate at the same speed but also so that the peripheral speed of the rollers is equal to the peripheral speed of the typewheels 16 and 18.

Figure 2:
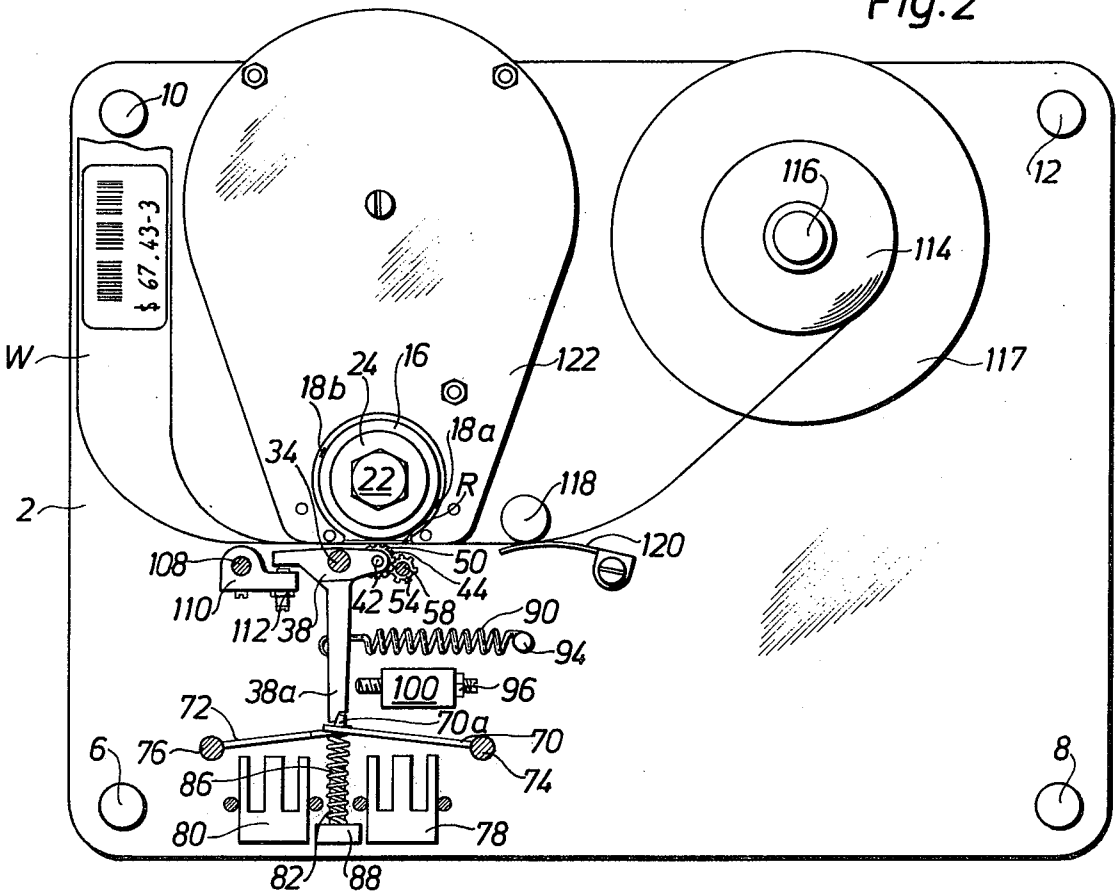
FIG. 2 is a front view taken along the line II—II in FIG. 1.
Figure 4:
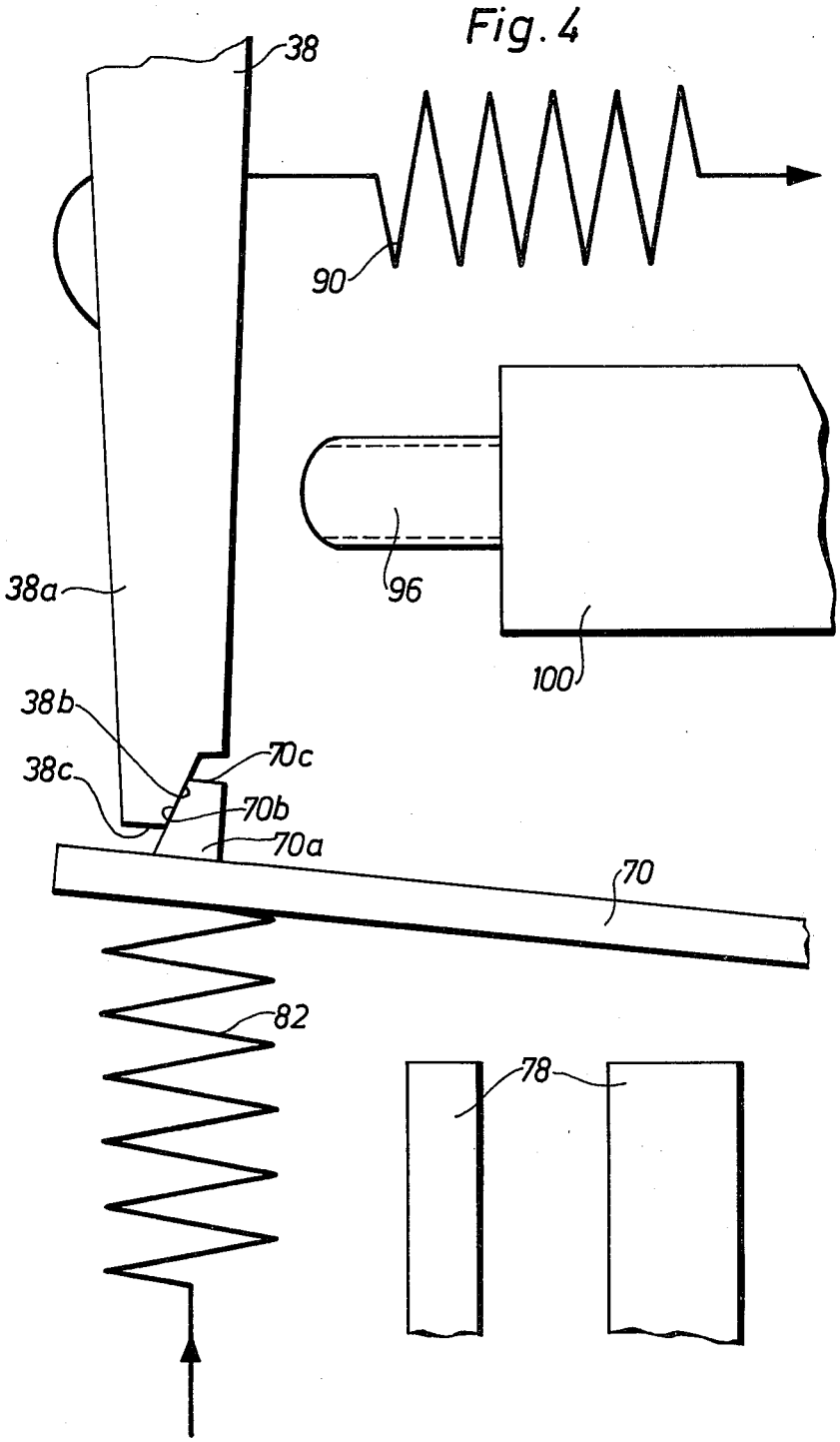
FIG. 4 is an enlarged view of certain component members forming part of the embodiment in FIG. 1.

The downwardly extending arm 38*a*, 40*a* of each four arm holder 38, 40 has an end surface 38*b*, 40*b* (see also FIG. 4) which forms an angle of approximately 26° to the vertical in FIGS. 2 and 4. This surface normally lies against a surface located on a peg 70*a* and 72*a* respectively arranged on an armature 70 and 72 respectively, said surface being parallel with the surface 38*b*, 40*b* in FIG. 2.

The armatures 70 and 72 are mounted for rotation on respective shafts 74 and 76 attached to the frame plates 2 and 36 and are arranged to be actuated, i.e. attracted and released by an electromagnet 78 and 80 respectively mounted beneath respective armatures in said frame plates. The armatures 70 and 72 (FIG. 2) are pulled upwards by compression springs, of which one, 80, is shown in FIG. 2. The upper ends of said springs abut the armatures 70 and 72 and are guided by two pins (only one, 86, is shown) which are mounted in a plate 88 arranged in frame plates 2 and 36; the lower ends of the springs engage the upper surface of the plate 88.

The downwardly extending arm 38*a*, 40*a* of each holder 38, 40 is drawn to the right when seen in FIG. 2 by a spring 90 and 92 respectively. The springs 90 and 92 are attached at one end thereof to respective arms 38*a* and 40*a*, while the other end of said springs is attached to a shaft 94, screwed to the frame plate 2. Movement of the arms 38*a*, 40*a* to the right is restricted by pegs 70*a*, 72*a*, and, subsequent to activating the armatures 70 and 72, by stop screws 96 and 98, which can be screwed to the right or to the left as seen in FIG. 2, to adjust the length of movement. The stop screws 96, 98 are arranged in a holder 100 screwed to the frame plate 2.

When an electro-magnet 78 or 80 is energized, its respective armature 70 or 72 will be attracted thereby, and the peg 70*a* or 72*a* will be drawn out of the movement path of the arm 38*a* or 40*a* to the right in FIG. 2 or 4. The arms 38*a* and 40*a* are drawn to the right, by means of springs, at a specific, determined force. As a result of the arrangement of the surfaces 38*b* and 40*b* sloping at approximately 26° to the vertical plane on respective arms 38*a* and 40*a*, the required pulling force of each electro-magnet 78, 80 need not be as great as the upwardly directed force created by the spring (82 shown) on the armature 70 and 72 respectively together with the friction acting between the two sloping surfaces 38*b* and 40*b* and the sloping surfaces on the pegs 70*a* and 72*a*, but need only reach the upwardly acting excess force which must be exerted by the spring 82 in order to positively retain an arm 38 or 40 in the position shown in FIG. 2 over the sloping plane of 26°, together with the aforementioned frictional force. This is due to the fact that spring 90 or 92 at an angle of 26° urge the armature downwards at a force equal to approximately half the force of said spring (tg 26° ≈ 0.5). For example, if the spring 90 exerts a pulling force of 2 kilogram-force at the sloping surfaces and the spring 82 exerts a pressure force of 1 Kg-force and the friction between the surfaces 38*a* and 70*a* is 0.2 Kg-force the tension force necessary for releasing the arm 38 is 0.2 kp (friction) + 0.2 kp (excess force) which = 0.4 Kg-force. It will therefore readily be perceived that relatively weak electro-magnets 78, 80 can be used, despite the fact that relatively large forces are applied to the arms 38*a*, 40*a*.

When an electro-magnet 78 or 80 is energised, the arm 38*a* or 40*a* is moved to the right until stopped by the stop screws 96 or 98. The roller 44 or 48 is then rotated counterclockwise in FIG. 2 so as to press the lbel strip W and an ink ribbon R against the typewheel 16 or 18, at the same time as both the rollers 44 and 48 and the typewheel 16 and 18 rotate. In this way the characters located on typewheels 16 and 18 will transfer print to the label strip W, via the ink ribbon R, until engagement between the typewheels 16, 18 and roller 44, 48 ceases.

Each time a character on the typewheel 18 and/or a code on the typewheel 16 has been printed, or a feed projection 18*a*, *b* has advanced the label strip W one step, the arm 38 and 40 is restored. The manner in which this is effected will now be described.

A circular steel disc 102 (FIG. 1 and 3) provided with eighteen teeth is mounted to the typewheel shaft 14. The disc 102 is arranged to operate in conjunction with a roller 104 mounted for rotation on an arm 106, which is secured to a shaft 108 mounted for rotation in the frame plates 2 and 36. The end of the arm 106 remote from the shaft 108 is provided with a hub 110 which is arranged on said shaft and in which two setting screws are screwed (only one screw, 112, is shown in FIG. 2).

The disc 102 is arranged to rotate at the same speed as the typewheels 16 and 18 and has the same number of teeth as positions on the typewheels, and hence the holders 38 and 40 will be restored in a clockwise direction each time a character and/or a code group has passed the printing position. The distance through which the holders are restored is determined by the setting of the setting screws.

When an electromagnet 78 or 80 is excited, the armature 70, 72 is attracted for a very short period of time and is restored very rapidly by the pressure spring (82 shown), to a position in which the upper, essentially horizontal surface 70*c*, 72*c* (see also FIG. 4) of the peg 70*a*, 72*a* is in contact with the lower, essentially horizontal surface 38*c*, 40*c* of the arm 38*a*, 40*a*. Subsequent to restoring the holder 38, 40 clockwise (to the left in FIG. 4), the peg 70*a*, 72*a* is spring biased upwards as soon as the sloping surfaces 38*b*, 40*b* and 70*b*, 72*b* reach each other.

No special feed means are provided for the label strip W, since the strip is automatically advanced through the printing positions or stations by rotary co-action between the typewheels 16, 18 and the rollers 44, 48. The label strip W comprises a smooth paper web on which paper labels are removably affixed by means of an adhesive at a pre-determined spaced apart relationship. The label strip is wound on a storage spool 114 mounted for rotation on a shaft 116 attached to the frame plate 2, and extends to the printing station via guide means 118, 120. A circular plate 117 mounted to the shaft 116 forms a support for the end of the storage spool 114 facing the frame plate 2.

The ink ribbon R suitably comprises disposable carbon ribbon and has a width smaller than half the width of the label strip W. The ribbon is housed in a cassette 122 (FIGS. 2 and 5 and 6) arranged to abut the frame plate 2. The cassette 122 is held in its intended position by means of a shaft 124 provided with a groove 124*a* and passing into a hole disposed in the frame plate 2, and by means of two studs (one, 128, is shown) located at the shafts 134 and 136 on the side of the cassette 122 facing the frame plate 2, said studs passing into corresponding holes in said frame plate. With the illustrated embodiment, the cassette 122 is assumed to be made from sheet metal. The cassette, however, may be made of a plastics material and may be discarded after use. The cassette 122 can be readily lifted from the shaft 124 and the pegs (128 is shown), and comprises two side plates 130 and 132, of which plates one, 130, abuts the frame plate 2. The plates 130 and 132 are detachably connected together by means of spacer rods 134, 136, 138 and 140 provided with screw threads. A circular intermediate plate 142 is arranged to be tightened against a spacer roller 144 by a screw 147 which is screwed into a hole located in the intermediate plate. The roller 144 is thus incapable of moving between the plates 132 and 142, and carries an ink ribbon reel 146, the width of which is slightly less than the width of the spacer roller, so that the ink ribbon reel can rotate around the same. The screw 147 is provided with a peg 148, which forms the centre axle for a collecting reel 150 mounted for rotation thereon, to which reel the shaft 124 projecting out of a hole in the plate 130 is secured.

Figure 6:
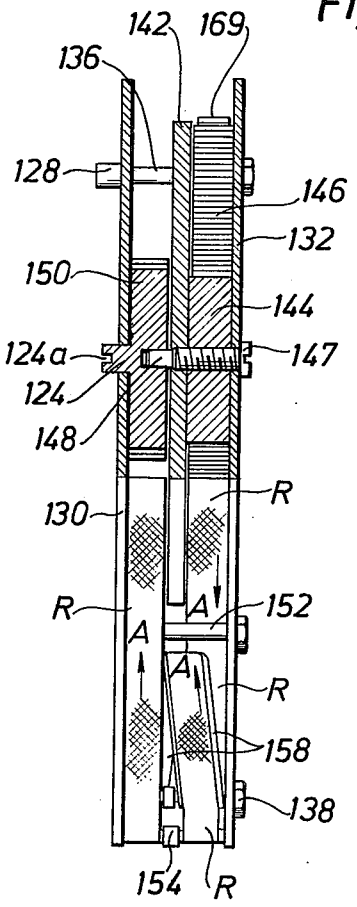
FIG. 6 is a sectional view through the line VI—VI in FIG. 5.
Figure 5:
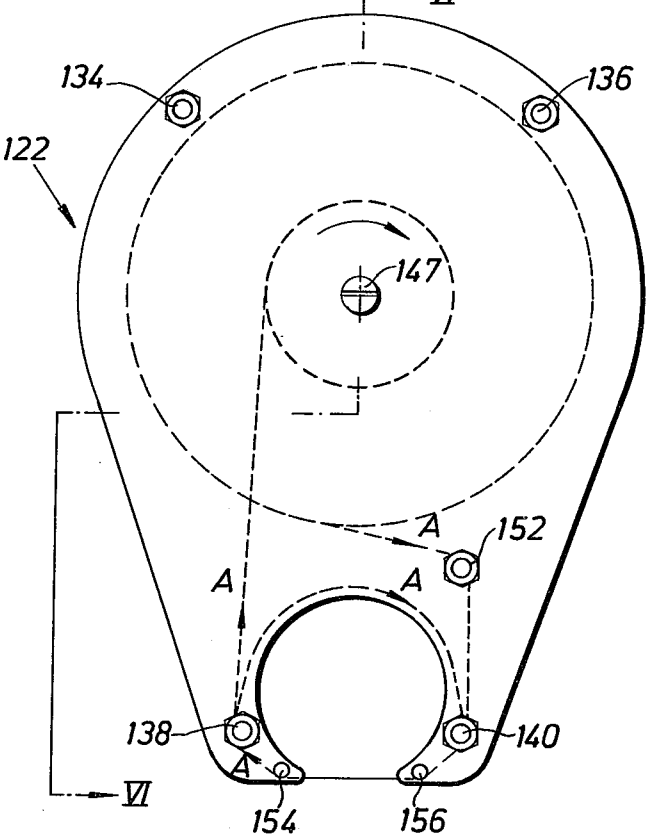
FIG. 5 is an enlarged front view of the cassette shown in FIG. 2.

The ink ribbon R passes from the roller 146 downwardly in FIG. 6 (see also the movement path of the ink ribbon illustrated with dash lines in FIG. 5) via a guide shaft 152 over the shaft 140; over a further shaft 156; over the right-hand portion of a further shaft 154 as seen in FIG. 6; over the right hand portion of the shaft 138 as seen in FIG. 6 around a guide plate 158 extending in a semi-circular arc from the right-hand portion of the shaft 138 as seen in FIG. 6 around a large portion of the periphery of the typewheels 16, 18 to the left-hand portion of the shafts 140 as seen in FIG. 6; over the last mentioned shaft; over the shaft 156; over the left-hand portion of the shafts 154 and 138 as seen in FIG. 6, to the collecting reel 150, to which reel one part of the ink ribbon is attached. The shafts 154 and 156 are secured to the plates 130 and 132 and, similar to the shafts 138 and 140, are provided with a bushing in the centre thereof to separate the two ink ribbon paths from each other.

The ink ribbon R thus passes the printing station beneath both the typewheel 16 and the typewheel 18, the unused portion of the ribbon first passing beneath typewheel 16 whereafter the used portion of the ink ribbon passes beneath the typewheel 18, to be used again. It has been established that a completely satisfactory print is also obtained from the typewheel 18, which as mentioned is provided with visually readable characters, despite the fact that the ink ribbon has already been used for printing the code groups on typewheel 16. The ink ribbon R is moved in the direction of arrows A in FIGS. 5 and 6 by being pressed against one or both typewheels 16, 18 as the rollers 44, 48 co-act with said typewheels, and hence no special feed means need be provided for the ink ribbon. The ink ribbon R is moved positively at each printing operation through a distance corresponding to the extension of a type on the typewheel 16 or 18, in the direction of rotation of said type.

Figure 3:
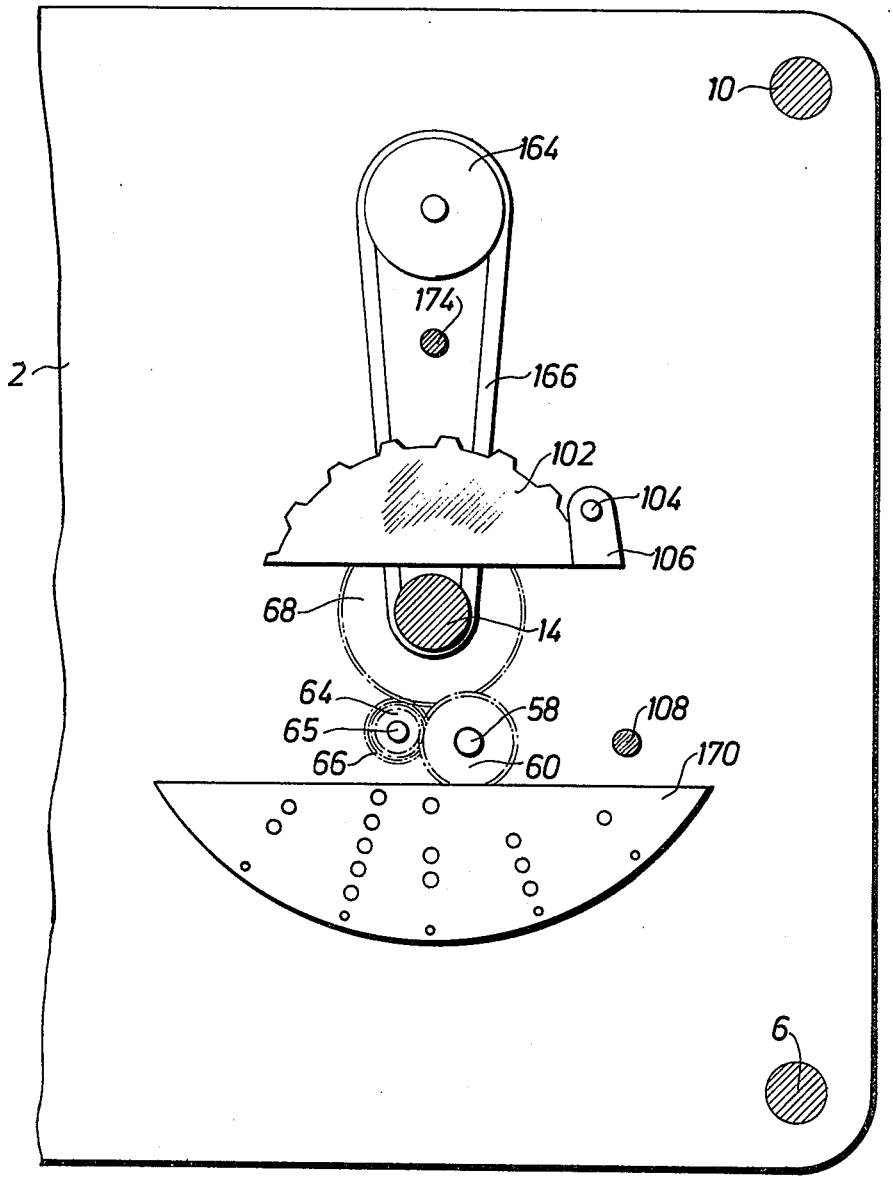
FIG. 3 is a sectional view through the line III—III in FIG. 1.

To enable the twice used ink ribbon R to be taken up on the wheel 50, the reel is rotated clockwise as seen in FIG. 5 over its shaft 124 and the groove 124*a* located therein by means of a peg 160 (FIG. 1), which is provided with a member which fits into the groove 124*a*. The peg 160 is mounted for rotation in a sleeve 162 attached to the frame plate 2. The peg 160 is securely connected with a disc 164 having a peripherally extending groove in which a resilient, plastics belt 166 is arranged to pass. The typewheel shaft 14 is provided with a circular groove 168, in which the plastic belt lies. As the shaft 14 rotates, the belt 166, which is under a certain degree of tension, will drag-drive the roller 150 via the described members, and the reel will take-up the used ink ribbon R. This drive or sliding clutch arrangement is not designed to be able to move the ink ribbon R from the storage spool 146 to the reel 150, this drive being effected by the cooperation between type wheel 16, 18 and the pressure rollers 44, 48, but is merely intended to take-up the tape subsequent to its passing the last printing position, i.e. the printing position beneath typewheel 18. A braking device, mounted in side plate 132 and having the form of a leaf spring 169 abutting the storage spool 146, is arranged to prevent the ink ribbon from being driven unintentionally by the aforementioned slipping clutch drive arrangement. Excitation of the electromagnet 78 and 80 at points of time when a character and/or code group to be printed are located immediately in front of the printing station is effected by a circular code disc 170 mounted on the typewheel shaft 14 (FIGS. 1 and 3). The code disc 170 is provided with 18 groups of holes (one group each for $T_1$ and $T_2$, the digits 1 – 9 and the characters $, ., -, B and E and two groups each for the digit o), each group of holes being arranged radially on the disc. The two groups of holes for $T_1$ and $T_2$ which are identical to each other are arranged diametrically opposite each other, as is also the case with the two identical groups of holes for the digit 0. There are six positions in each group in which the holes can appear. In the position lying nearest the periphery of the code disc, there is always located one hole, which generates clock pulses. The number of holes in the group and the positioning of the holes forms a code which is different to any other group. A stirrup-shaped holder 172 secured to the frame plate 2 by means of shaft 174 carries a row of six lamps 176*a – f* and a row of six photodiodes 178*a – f*, said rows being arranged on either side of the code disc 170 and extending radially along said disc in a manner such that each lamp is located opposite a position on the code disc and the associated photodiode is located on the other side of the code disc opposite the lamp (see also FIG. 7).

When a label is to be printed, a drum wheel switching devices 180 for example (FIG. 7) is set to positions corresponding to the characters and/or code groups on type wheels 16, 18 to be printed on the label. Each switching device is provided with the same visual characters as those located on the type wheel 18, i.e. with characters $, 0, 1, 2, 3, 4, 5, 6, 7, 8, 9, . and -, and with B and E. The number of switching devices corresponds to the maximum number of orders or character positions liable to be found on a label. A starting button 82 is then pressed, said button starting a binary counter 186 connected to a binary-decimal converter 188. The converter 188 is arranged to activate the switching devices 180 of different orders so that said switching devices transmit sequentially binary information corresponding to their setting to a diode matrix 190. The diode matrix 190 transmits the binary information from each switching device 180 sequentially to a comparison device 192, to which the binary signals from the photodiodes 178*b – e* which sense the code groups on the code disc 170, are also applied.

Figure 7:
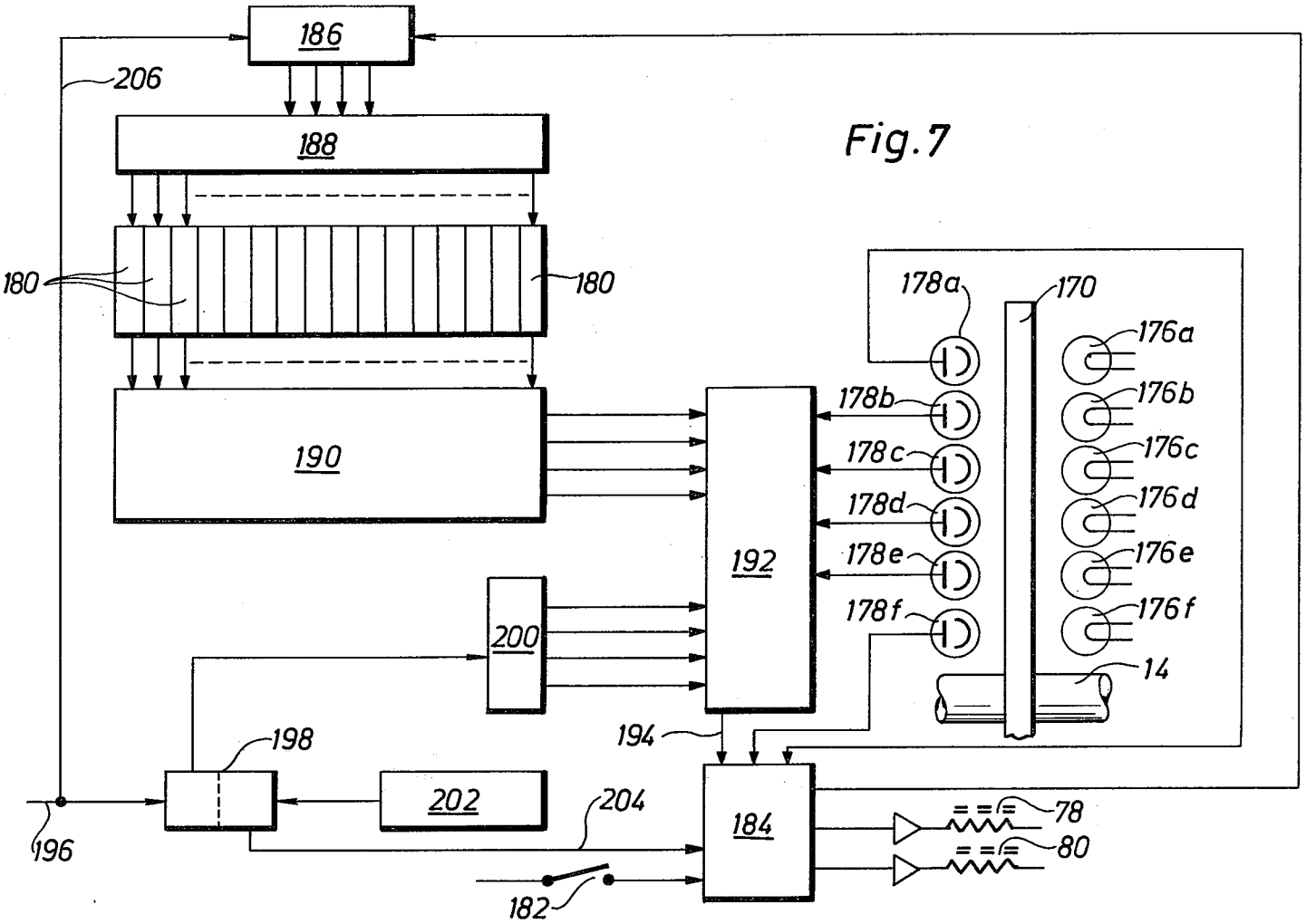
FIG. 7 is a block diagram showing the electronic control circuits required for printing and feeding the label strip.

The clock pulse signals from the photodiode 178*a* are transmitted to the control and pulse delay circuits 184, which thereby control the time sequence for the operation of the members shown in FIG. 7. The signals from the photodiode 178*f*, said signals comprising conventional parity control signals, are also transmitted to the circuits 184 to be compared with the signals from conductor 194. In the event of a parity error, excitation of the electromagnets 78, 80 is inhibited in a known manner.

When the signals from the photodiodes 178*b – e* and the signals from the diode matrix 190 coincide in the comparison device 192, the diode matrix 190 transmits a signal on conductor 194 to the control and pulse delay circuits 184, which in turn transmit the signal to one or both of the electromagnets 78, 80 to energize the same, whereupon respective aramtures 70, 72 are attracted and the associated holders 38, 40 are swung counterclockwise as seen in FIG. 2 to press the rollers 44, 48 against the typewheels 16 and 18, whereupon the label present between the rollers and the type wheels is provided with print corresponding to the print set on drum wheel switching devices 180. Immediately upon completion of this printing operation, the rollers 44, 48 are removed from the printing position by means of the toothed disc 102.

Subsequent to all settings of the switching devices 180 having been sensed and compared with the code groups of the code disc 170, the label is advanced by the projections 18*a* and 18*b* on the typewheel 18 a number of steps, to locate the leading portion of the label next in line in the printing position ready to receive print. As will be evident from the aforegoing, the label shall not be printed during this last mentioned label feeding step. To this end, a signal is transmitted on conductor 196 as soon as the switching device 80 in a certain pre-determined position, for example the last position, has transmitted its information to the diode matrix 190. When this has occurred, a bi-stable element 198 is switched to 1 position, whereupon a signal is transmitted to a converter 200 which transmits binary informtion corresponding to the two code groups for label strip feeding purposes, i.e. $T_1$ and $T_2$ arranged on the code disc 170. The binary information from the converter 200 is transmitted to the comparison device 192 at the same time as the binary informtion from the diode matrix 190 to the comparison device 192 is inhibited. When one of the two code groups for effecting label strip movement pass the photodiode 178*d – e*, indentity exists between the signals transmitted to the comparison device 192 and the signals from the converter 200 to said device, and hence the label strip will be advanced a number of steps until a label detector 202, which may comprise for example a lamp and a photocell placed on either side of the label strip in the immediate vicinity of the printing position, detects that the leading portion of a new label has reached the printing position and is ready to receive print. When this stage is reached, the detector 102 transmits a signal to the bi-stable element 198 to restore the same, wherewith a signal is transmitted via conductor 204 to the control and pulse delay circuits 184, which then transmits a signal to the counter 186, to re-start same. The counter 186 ceased to count when a signal was applied to the bi-stable element 198 via the conductor 196, owing to the fact that the conductor 196 is connected to a conductor 206 which in turn is connected to the counter.

Normally, it is desired to print a plurality of identical labels in sequence. In such a case, a mechanical counter (not shown) may be set, for example, to the desired number of labels, each printed label being permitted to actuate the counter to count backwards one step. When the counter has reached zero, it can be arranged to actuate the aforementioned starting button 182, to cause said button to take an inactivated position, whereupon further printing is prevented.

The circuits and components forming part of or operating in conjunction with the aforedescribed electromagnets, converters, switching devices, counters, detectors etc. are well known to those skilled in this art and will not be described in detail.

Although the invention has been described and illustrated with respect to a particular embodiment thereof, it will be understood that this embodiment is not restrictive of the invention, but that other embodiments are conceivable within the scope of the accompanying claims.

We claim:

1. A printing device having at least one printing station for printing on labels in the form of a striplike record medium comprising:

first and second coaxially mounted rotatable typewheels of substantially the same diameter;

a rotatable pressure roller associated with each typewheel and arranged in spaced relation to its associated typewheel;

actuating means for bringing said typewheels and said pressure rollers into engagement for printing upon a label disposed therebetween while advancing said label through said printing station;

said label being advanced through a distance which is a function of the period of time said typewheels and said pressure rollers are engaged;

said actuating means removing said typewheels and said presure rollers from engagement after completion of a label-printing and label-advancing operation; and motorized drive means coupled to said typewheels and said pressure rollers and being adapted to continuously rotate said typewheels and said pressure rollers at substantially the same peripheral speed;

said first typewheel being provided around the periphery thereof with a plurality of alphanumeric type characters;

said second typewheel being provided around the periphery thereof with a plurality of type characters in coded form corresponding to at least certain ones of said alphanumeric characters;

one of said typewheels being provided at the periphery thereof with at least one projection located on said typewheel at a position at which said typewheel is not provided with type characters;

said at least one projection being adapted to contact a label disposed between said typewheel and said pressure rollers; whereby, during rotation of said typewheel and said presure rollers, said at least one projection advances said label through a distance which is a function of the period of time said typewheels and said pressure rollers are engaged.

2. A printing device as set forth in claim 1, wherein:

each pressure roller is carried by a holder provided with a first contact surface;

said actuating means comprising an electromagnet having a movable armature including a second contact surface;

each of said contact surfaces forming an acture angle with the path of movement of said armature;

said holder being urged against said first contact surface by resilient means;

said electromagnet being able to attract said armature with a force which is smaller than the force of said resilient means acting on said holder and said armature as a result of said contact surfaces forming an angle with the path of movement of said armature.

3. A printing device as set forth in claim 2, wherein:

said actuating means includes restoring means for restoring said pressure roller to an inactive position each time a type character position on said typewheel passes a position for label-printing.

4. A printing device as set forth in claim 3, wherein:

said restoring means comprises a toothed disc rotatable at the same speed as said typewheels; and further including pivot means linking the rotary motion of said disc and each of said holders for pivotally moving the holder and its associated pressure roller to said inactive position.

5. A printing device as set forth in claim 1, further including:

ribbon means substantially enclosed in a housing having an opening located in proximity to said typewheels;

said housing accommodating a storage reel and an actuable take-up reel for said ribbon means;

said ribbon means passing from said storage reel to said take-up reel via guide means;

said guide means guiding said ribbon means around at least a portion of the periphery of each of said typewheels to thereby enable said typewheels to create a printed impression on said label through said ribbon means.

6. A printing device as set forth in claim 5, wherein:

said reels are coaxially disposed within said housing; and said guide means comprises a helical guide strip extending around a portion of the periphery of said typewheels.

7. A printing device as set forth in claim 6, wherein:

said typewheels are disposed within said housing opening.

* * * * *

UNITED STATES PATENT AND TRADEMARK OFFICE

CERTIFICATE OF CORRECTION

PATENT NO. : 4,019,617

DATED : April 26, 1977

INVENTOR(S) : Gosta R. Englund and Ernst C-G Lindelow

It is certified that error appears in the above-identified patent and that said Letters Patent are hereby corrected as shown below:

Column 1, line 60, "type" should be --types--
line 68, "drawins:" should be --drawings--
Column 2, line 17, "ridgid" should be --rigid--
Column 4, line 43, "kp" should be --kg-force--
line 43, "kp" should be --kg-force--
line 52, "lbel" should be --label--

Column 8, line 18, insert " " around the 1
Column 8, line 20, "informtion" should be --information-- line 42, "presure" should be --pressure--
Column 10, line 4, "acture" should be --acute--

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*